US012790897B2

(12) United States Patent
Harrison et al.

(10) Patent No.: US 12,790,897 B2
(45) Date of Patent: Nov. 10, 2026

(54) DRILL HEAD FOR USE WITH MICROTUNNELING APPARATUS

(71) Applicant: OptionX Holdings Pty Ltd, Burleigh Waters (AU)

(72) Inventors: Stuart Harrison, Burleigh Waters (AU); Allen Henley, Burleigh Waters (AU); Albert Fourie, Burleigh Waters (AU)

(73) Assignee: OptionX Holdings Pty Ltd, Burleigh Waters (AU)

( * ) Notice: Subject to any disclaimer, the term of this patent is extended or adjusted under 35 U.S.C. 154(b) by 0 days.

(21) Appl. No.: 18/875,354

(22) PCT Filed: Jun. 14, 2023

(86) PCT No.: PCT/AU2023/050528
§ 371 (c)(1),
(2) Date: Dec. 16, 2024

(87) PCT Pub. No.: WO2023/240314
PCT Pub. Date: Dec. 21, 2023

(65) Prior Publication Data

US 2025/0369289 A1 Dec. 4, 2025

(30) Foreign Application Priority Data

Jun. 14, 2022 (AU) ..... 2022901617

(51) Int. Cl.
*E21B 7/04* (2006.01)
*E21B 4/00* (2006.01)
(Continued)

(52) U.S. Cl.
CPC ..... *E21B 7/04* (2013.01); *E21B 4/00* (2013.01); *E21B 7/046* (2013.01); *E21B 7/067* (2013.01);
(Continued)

(58) Field of Classification Search
CPC ..... E21B 4/00; E21B 47/0025; E21B 10/60; E21B 17/05; E21B 7/04; E21B 7/046; E21B 47/002; E21B 17/046; E21B 10/26
See application file for complete search history.

(56) References Cited

U.S. PATENT DOCUMENTS 4,828,050 A 5/1989 Hashimoto
5,470,132 A * 11/1995 Cartwright ..... E21B 7/201 299/56
(Continued)

FOREIGN PATENT DOCUMENTS

CN 202249762 U 5/2012
CN 113356762 A 9/2021
(Continued)

OTHER PUBLICATIONS

United States Patent Office Non-Final Rejection for U.S. Appl. No. 18/875,345 dated Jun. 18, 2025 (6 pages).
(Continued)

*Primary Examiner* — Yong-Suk (Philip) Ro
(74) *Attorney, Agent, or Firm* — Michael Best & Friedrich LLP

(57) ABSTRACT

This invention relates to a drill head for the use with a microtunneling apparatus (1) for producing a substantially horizontal bore hole (8). The drill head (4) includes a cutter bar (12) that is rotatable within a working zone (13) of the bore (8) which produces swarf which can be extracted from the working zone (13). The drill head (4) includes a pressure adjustment mechanism including a throat member (49) which is adjustable at the distal end of the drill head (4) to adjust the extraction of swarf from the working zone (13).

19 Claims, 11 Drawing Sheets

(51) Int. Cl.

| | |
|---|---|
| ***E21B 7/06*** | (2006.01) |
| ***E21B 10/42*** | (2006.01) |
| ***E21B 10/60*** | (2006.01) |
| ***E21B 17/05*** | (2006.01) |
| ***E21B 47/002*** | (2012.01) |

(52) U.S. Cl.
CPC ..... *E21B 10/42* (2013.01); *E21B 10/60* (2013.01); *E21B 10/602* (2013.01); *E21B 17/05* (2013.01); *E21B 47/002* (2020.05)

(56) References Cited

U.S. PATENT DOCUMENTS

| | | | | |
|---|---|---|---|---|
| 6,810,972 | B2 | 11/2004 | Sved | |
| 7,845,432 | B2 | 12/2010 | Salins et al. | |
| 7,942,217 | B2 | 5/2011 | Salins et al. | |
| 8,256,536 | B2 | 9/2012 | Harrison et al. | |
| 8,439,450 | B2 | 5/2013 | Harrison et al. | |
| 8,684,470 | B2 * | 4/2014 | Harrison | E21D 9/093 299/1.3 |
| 8,839,885 | B2 | 9/2014 | Shuman et al. | |
| 9,506,344 | B2 | 11/2016 | Harrison et al. | |
| 10,041,302 | B2 | 8/2018 | Blangé et al. | |
| 10,151,150 | B2 | 12/2018 | Blangé et al. | |
| 12,523,103 | B2 | 1/2026 | Fourie et al. | |
| 12,534,963 | B2 | 1/2026 | Fourie et al. | |
| 2004/0188142 | A1 | 9/2004 | Self et al. | |
| 2005/0103527 | A1 | 5/2005 | Church et al. | |
| 2005/0257959 | A1 * | 11/2005 | Richardson | F16L 1/036 175/22 |
| 2009/0152012 | A1 * | 6/2009 | Salins | E21B 21/12 175/339 |
| 2009/0166089 | A1 | 7/2009 | Millet | |
| 2010/0206635 | A1 * | 8/2010 | Harrison | E21D 9/093 175/344 |
| 2010/0206637 | A1 * | 8/2010 | Harrison | E21D 9/093 175/327 |
| 2011/0266062 | A1 | 11/2011 | Shuman et al. | |
| 2013/0008718 | A1 | 1/2013 | Nguyen et al. | |
| 2013/0008723 | A1 | 1/2013 | Hoelting et al. | |
| 2013/0098686 | A1 | 4/2013 | Wentworth | |
| 2014/0151123 | A1 | 6/2014 | Spoelstra | |
| 2014/0219725 | A1 | 8/2014 | Harrison et al. | |
| 2016/0348439 | A1 | 12/2016 | Wang et al. | |
| 2025/0215750 | A1 | 7/2025 | Fourie et al. | |
| 2025/0215753 | A1 | 7/2025 | Fourie et al. | |
| 2025/0361777 | A1 | 11/2025 | Geldard et al. | |

FOREIGN PATENT DOCUMENTS

| | | | |
|---|---|---|---|
| CN | 115434648 | A | 12/2022 |
| WO | 2007143772 | A2 | 12/2007 |
| WO | 2014032006 | A1 | 2/2014 |
| WO | 2014078660 | A1 | 5/2014 |

OTHER PUBLICATIONS

International Search Report for Application No. PCT/AU2023/050528 dated Aug. 11, 2023 (4 pages).
United States Patent Office Non-Final Rejection for U.S. Appl. No. 18/875,349 dated Feb. 12, 2026 (19 pages).

* cited by examiner

DRILL HEAD FOR USE WITH MICROTUNNELING APPARATUS

TECHNICAL FIELD

This invention relates to a drill head for use with microtunneling apparatus, and a microtunneling apparatus including such a drill head. More specifically the drill head is for use at the end of a drill string of the microtunneling apparatus. The drill head has a particular application for use being launched from a pit to producing a substantially straight bore, and it will be convenient to hereinafter describe the invention with reference to this particular application. It ought to be appreciated however that the invention may have other applications such as being launched from the surface and producing a curved bore.

BACKGROUND OF INVENTION

The term microtunneling as used throughout this specification is a reference to drilling or boring a non-vertical bore where the operator is not required to enter the bore. The bore produced will generally have a diameter of no greater than 1500 mm, however this value can vary depending upon the microtunneling industry perception from time to time. It will be convenient however to hereinafter describe the invention within these references.

The provision of services such as telecommunications, gas, water supply, stormwater, sewerage, data, and electricity might traditionally involve excavating a trench, laying the services and backfilling the trench. This might have been convenient where the trench is relatively shallow and where there is no existing infrastructure on, for example, a "green fields" site. However, as the depth of the trench increases, it can be difficult to provide machinery at a cost-effective rate to trench to the required depth. Furthermore, if there is other existing infrastructure that would be adversely impacted by an open trench, such as disruption or damage to major roadways or existing services, other methods of creating a conduit must be considered.

One other such method is microtunneling which will generally involve drilling apparatus having a drill head with a cutter bar located at the end of a drill string that is rotated across a working surface to drill a bore through the ground. The drill string is formed from a number of segments which each include a drive shaft that transfers torque from a drive apparatus on the surface, or at the bottom of a vertical drive pit, to the drill head underground. The drill string can also include a channel to accommodate operating lines, such as hydraulic pipes and communication cables, or to supply fluid from the drive pit to w working zone in which the cutter head operates. The drill string can also include an exhaust conduit through which the swarf and fluid from the working zone can be extracted back to the drive pit and ultimately to the surface. Where the drill head is launched from a pit, a laser can be sighted along the drill string as a point of reference to facilitate maintaining a straight drill string.

Where ground conditions are perfectly homogeneous operating a microtunneling apparatus to produce a satisfactory bore is fairly straightforward. Unfortunately, perfectly homogeneous ground conditions are extremely rare, and the drill head will tend towards whichever ground is offering the least resistance. Whilst attempts have been made to produce steerable drill heads, such as that described in the inventor's earlier application WO2007/143772, the inventor has appreciated that such drill heads have their limitations in producing a straight bore when steering at the tip of the drill head.

The inventor has also appreciated that when operating in nonconsolidated or fluid ground, the swarf extraction can exceed the operation of the cutter bar causing an uneven collapse of the working face. This will make it difficult for the operator to achieve a straight bore, even with a steerable drill head. Further access to the exhaust conduit can be blocked by excess swarf, particularly where the cutter bar has been unable to process the swarf cut from the working face. The access to the exhaust conduit can get blocked and it is not clear to the operator if the cause of the blockage is in the working zone or in the exhaust conduit itself.

The invention aims to address one or more of the forgoing problems.

A reference herein to a patent document or other matter which is given as prior art is not to be taken as an admission that that document or matter was, in Australia, known or that the information it contains was part of the common general knowledge as at the priority date of any of the claims.

SUMMARY OF THE INVENTION

According to one aspect of this invention there is provided a drill head for use with a microtunneling apparatus to produce a bore including a housing having an annular shell and a radial member adjacent a distal end of the housing, a cutter bar having at least one cutting element positioned for front cutting, the cutter bar is rotatable across the radial member within a working zone of the bore to produce swarf, an air cavity extending longitudinally of the housing leading to an air aperture in the radial member for supplying air to the working zone, the radial member having at an exhaust aperture leading to an exhaust cavity extending longitudinally of the housing for extracting swarf from the working zone, the air cavity, the working zone and the exhaust cavity defining an air flow path, a pressure adjustment mechanism operable at the distal end of the housing for adjusting air pressure in the working zone so as to adjust the extraction of swarf from the working zone.

The pressure adjustment mechanism may take any suitable form and in one preferred form it includes a throat member that is positioned between the air aperture and the extraction aperture to create a venturi flow therebetween, the throat member is adjustable to control venturi flow of air in the working zone. The throat member may include a curved surface which is positioned in the air flow path. The curved surface is adapted to interact with the air flow in a manner similar to a venturi. The throat member is preferably movable between an extended position and a retracted position relative to the radial member. In this manner the throat can adjust similar to adjusting the throat of a venturi. It is preferred that the throat member is adapted such that when in the extended position a maximum negative pressure is developed in the working zone and when in the retracted position a minimum negative pressure is developed in the working zone.

The cutter bar preferably has at least one spray outlet (hereafter bar spray) adapted for spraying fluid towards the radial member. Further the housing may have at least one spray outlet (hereafter exhaust spray) adapted for spraying fluid towards the exhaust aperture. The housing may also have at least one spray outlet (hereafter housing spray) adapted for spraying fluid towards the cutter bar.

The drill head preferably includes an annular body to a rear of the annular shell, an input shaft at a proximal end of the annular body that is rotatable about a drive axis, an output shaft extending towards the distal end of the annular shell associated with the cutter bar so that the cutter bar rotates about an output axis, an articulated coupling within the housing between the input shaft and the output shaft that is adjustable so as to adjust an angle of articulation between the input shaft and the output shaft. The articulated coupling may include a drive gear associated with the input shaft, a driven gear associated with the output shaft and geared sleeve which are adapted to allow for adjustment of the articulated coupling. The drill head preferably includes a plurality of radially mounted actuators positioned about the articulated joint for adjusting the angle of articulation wherein the actuators are hydraulic rams (hereafter articulation rams) each including a piston (hereafter articulation piston) which is arranged to move in a longitudinally of the housing, each articulation piston having a part spherical surface adapted to interact with a socket so as to allow the articulation piston to move axially while permitting angular adjustment of the articulated coupling. It is preferred that the annular shell is adapted to move radially relative to the annular body for adjustment of the direction the annular shell within the bore when in use. The drill head preferably includes a plurality of radially mounted hydraulic rams (hereafter shell rams) each including a piston (hereafter shell piston) which is arranged to engage an inner surface of the annular shell and adapted to move in a radial direction so as to adjust the position of the annular shell relative to the annular body.

According to another aspect of this invention there is provided a microtunneling apparatus for producing a bore including a drive apparatus for location in a pit, a drill string for connection to the drive apparatus, the drill string having a drive shaft that is rotatable on operation of the drive apparatus, a drill head according to any one of the preceding claims for connection to the drill string such that rotation of the drive shaft results in rotation of the cutter bar.

A microtunneling apparatus preferably includes a pair of elongate members located at proximal end of the housing for interacting with a latch connection at a distal end the drill string each elongate member is adapted to be adjustable so as to vary the tolerance between proximal end of the housing and the distal end of the drill string. The drill string is preferably formed by a plurality of connected string segments each string segment including a latch connection for manually connecting adjacent string segments. Further the drill string includes a first cavity adapted for supplying air from the drive apparatus to the working zone and a second cavity for extracting swarf from the working zone to the drive apparatus. The first cavity may also be adapted for sighting a laser there along to a rear surface of the radial member.

It is preferred that the drill string includes a channel extending longitudinally thereof to accommodate cabling extending between the drive apparatus and the drill head so as to allow for operation of the drill head by an operator remote from the working zone, including at least adjustment of the pressure adjustment mechanism remote from the working zone.

It will be convenient to hereinafter describe the invention in greater detail by reference to the attached illustrations of a preferred embodiment of the drill head according to the invention. The particularity of those illustrations, and the accompanying detailed description is not to be understood as superseding the generality of the preceding definition of the invention according to each of its aspects. Whilst some of the illustrations are provided in a vertical/portrait orientation it is to be understood that the microtunneling apparatus is intended for operation in a horizontal or substantially horizontal orientation. The illustrations are provided in the portrait vertical/portrait orientation to enhance the level of detail.

BRIEF DESCRIPTION OF DRAWINGS

In order that the invention may be more fully understood, some embodiments will now be described with reference to the Figures in which.

DETAILED DESCRIPTION

Figure 1:
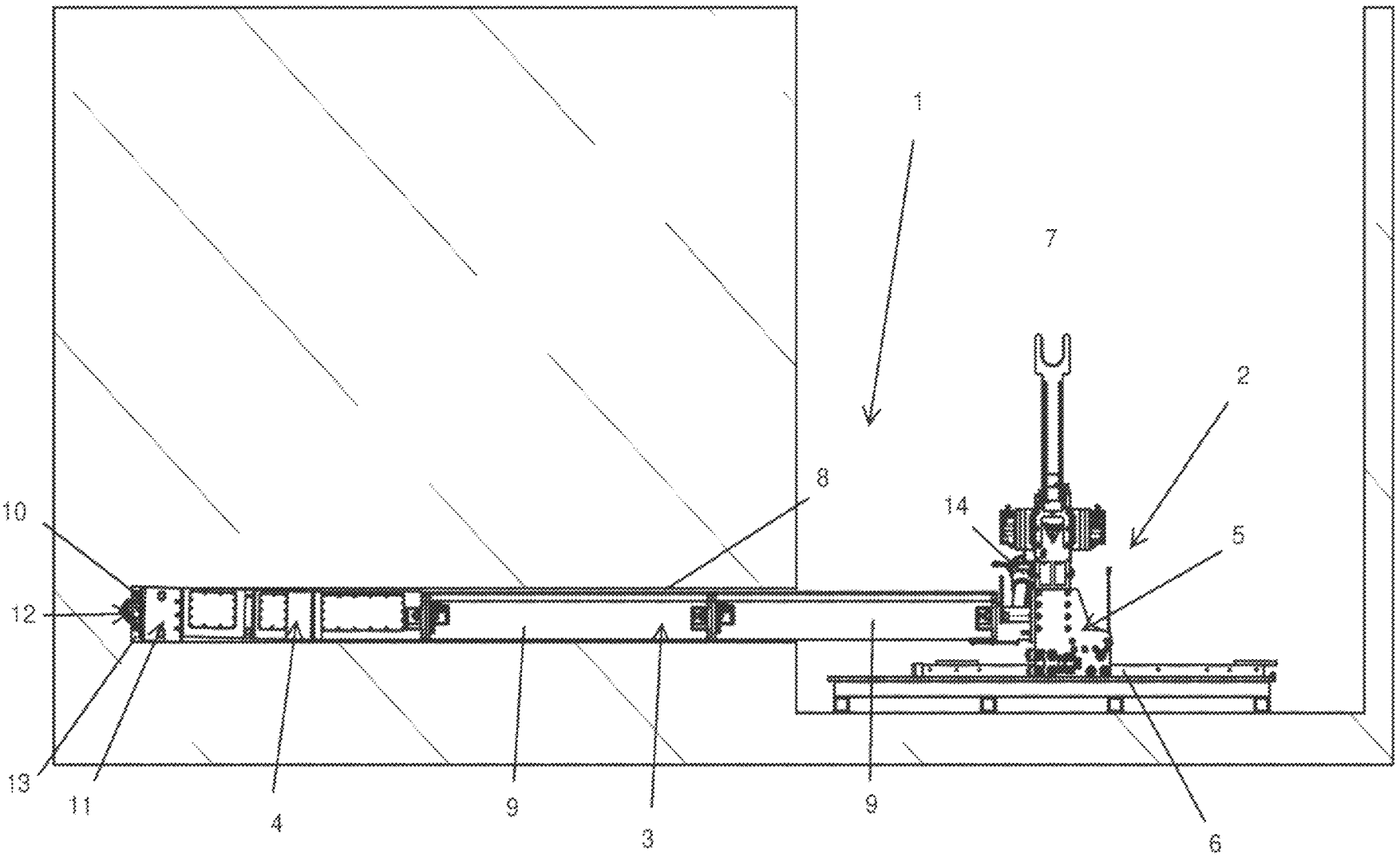
FIG. 1 is a side elevation view of a preferred embodiment of the microtunneling apparatus according to the invention.

Referring now to FIG. 1 which illustrates an example of a microtunneling apparatus 1 when in use. The microtunneling apparatus 1 includes in summary, drive apparatus 2, a drill string 3 and a drill head 4. The drive apparatus 2 includes a driver 5 positioned on a platform 6 which is adapted movable there along. The platform is positioned at the bottom of a pit 7 so that the driver 5 can be moved horizontally to produce a horizontal bore 8. In this manner it is distinguished form a HDD system as it is located at the bottom of the pit 7 as opposed to on the surface as in the case of a HDD system.

FIG. 1 illustrates the drill string 3 being formed by two string segments 9, with a proximal end of the first string segment 9 engaging the driver 5 whilst a distal end of the second string segment 9 engaging the drill head 4. A distal end of the drill head 4 is engaging a working face 10 of the bore 8. The drill head 4 includes an annular shell 11 and a cutter bar 12 which are more clearly illustrated in FIG. 4 whereby the cutter bar 12 is rotatable relative to the annular shell 11 on operation of the driver 5. The cutter bar 12 rotates within a working zone 13 which is the area between the annular shell 11 and the working face 10.

FIG. 1 also illustrates an exhaust outlet 14 which can be connected to a vacuum extraction facility (not shown) on the surface by way of a pipe (not shown) for extracting swarf from the working zone 13 in a manner that will be described in greater detail with reference to latter illustrations.

Figure 2:
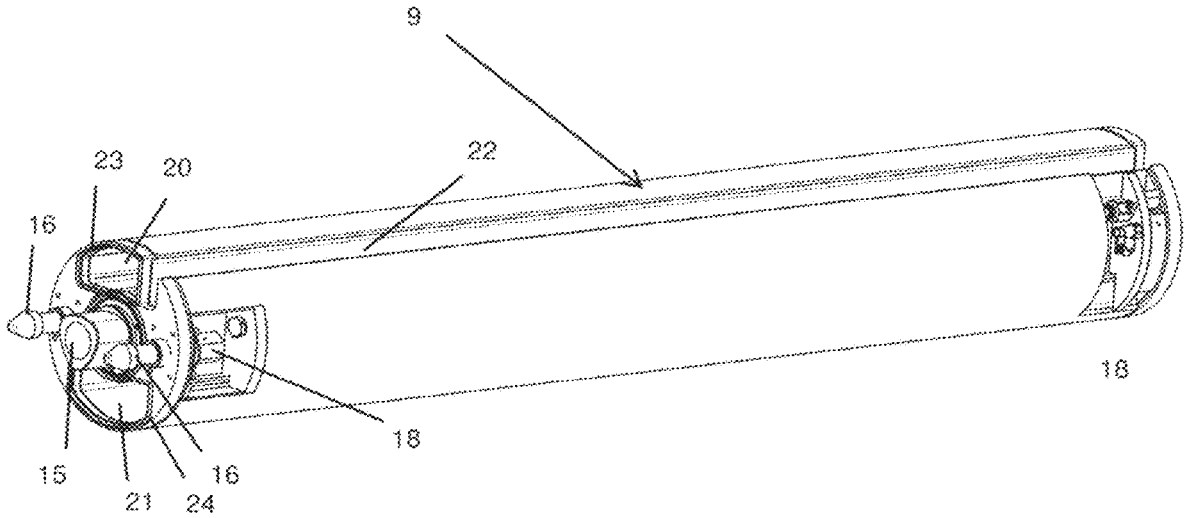
FIG. 2 is an isometric view of a string segment of the drill string as shown in FIG. 1 from a first perspective.
Figure 3:
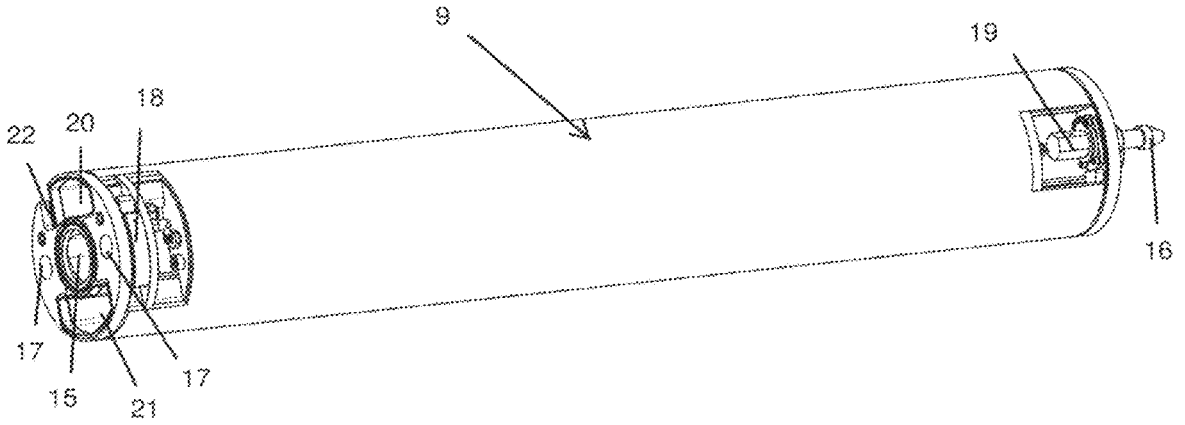
FIG. 3 is an isometric view of the string segment from FIG. 2 from a second perspective.

FIGS. 2 and 3 illustrate a preferred embodiment of each string segment 9 which includes a drive shaft 15 being formed with a protrusion at a proximal end of each string segment 9 as illustrated in FIG. 2, and a socket at a distal end of each string segment 9 as illustrated in FIG. 3. In this manner the drive shaft 15 of adjacent string segments 9 can connect to produce a substantially continuous drive shaft from the driver 5 to the drill head 4. The driver 5 is adapted to rotate the drive shaft 15 about a working axis which extends centrally of the drill string 3.

FIG. 2 illustrates each string segment 9 having a pair of elongate pins 16, whilst FIG. 3 illustrates each string segment 9 being formed with a pair of apertures positioned either side of the drive shaft 15. A catch mechanism 18 is arranged each aperture 17 which is adapted to capture each elongate pin 16 when a pair of string segments 9 are positioned adjacent each other. FIGS. 2 and 3 also illustrate a nut 19 positioned to a rear of each of the elongate pins 14 which can be rotated relative to the pins 16 to adjust the length to which each pin 16 projects out from the proximal end of the string segment 9. In this manner the connection between adjacent string segments 9 can be tightened or loosened depending on the direction of rotation of the nut 19.

FIGS. 2 and 3 also illustrate a first conduit 20, a second conduit 21 and an open channel 22 which each extend longitudinally from a proximal end to a distal end of each string segment 9. Further each of the first conduit 20 and second conduit 21 are provided with a first seal 23 and a second seal 24 surrounding the entrance to the first conduit 20 and second conduit 21 at least at the proximal end of the string segment 9. The first conduit 20 is adapted for supplying air towards the working zone whilst the second conduit 21 is adapted for extracting the air and swarf from the working zone 10 back to the exhaust outlet 14 (see FIG. 1). The first seal 23 and second seal 24 are adapted to inhibit the egress of air or swarf from the first conduit 20 and second conduit 21 respectively. The channel 22 is adapted to receive cabling (not shown) therein which extends from the driver 5 to the drill head 4. The cabling can include hydraulic fluid, cleaning fluid and communications for operation of the drill head 4 in a manner that will be more clearly understood by reference to latter illustrations.

Figure 4:
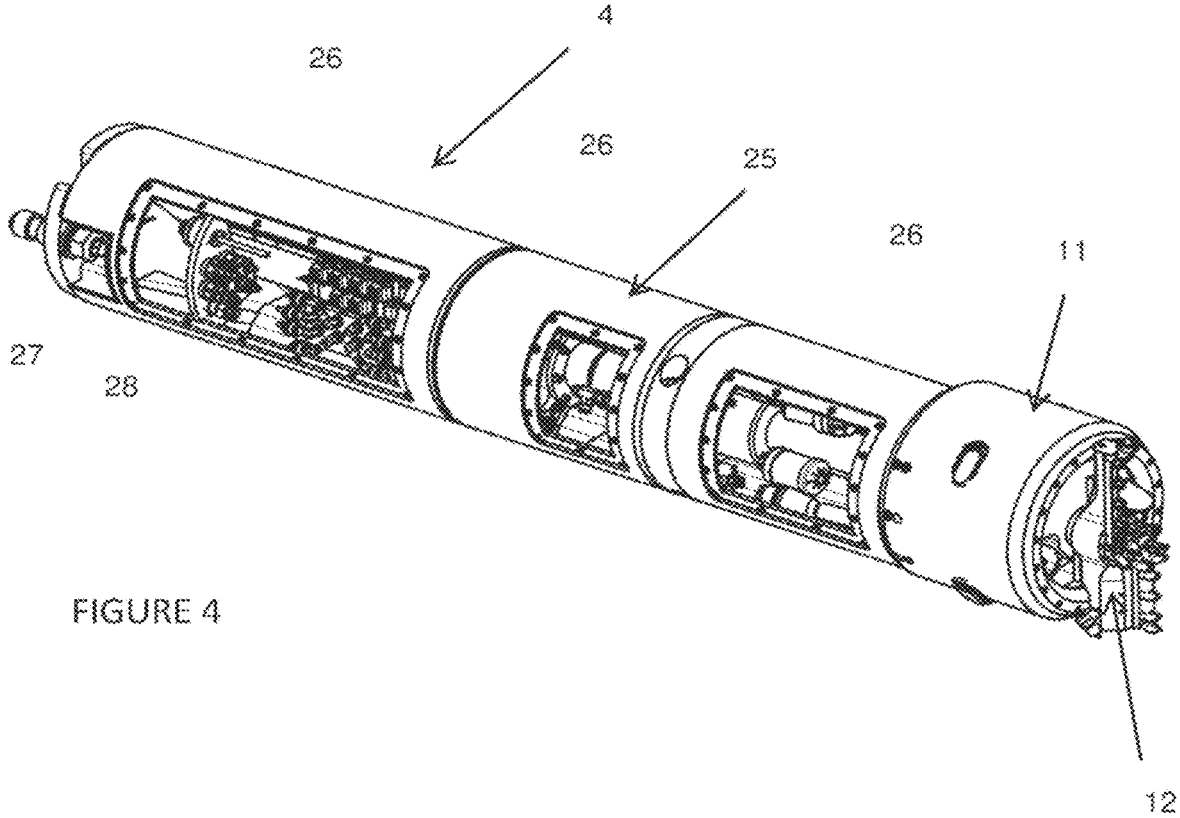
FIG. 4 is an isometric view of a preferred embodiment of the drill head according to one aspect of the invention.
Figure 5:
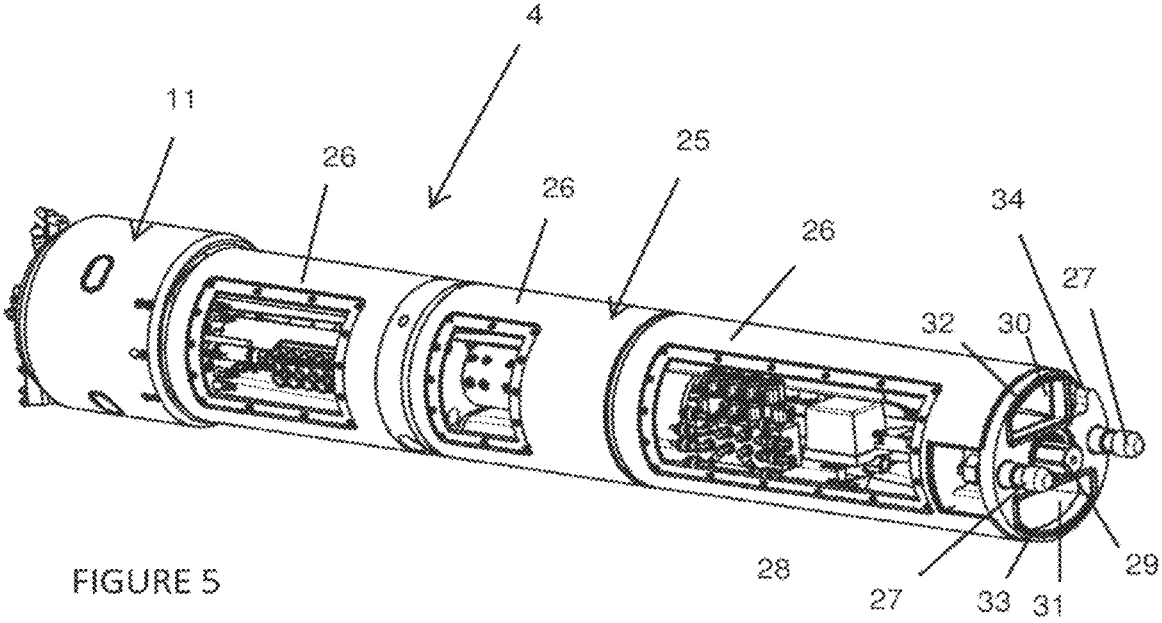
FIG. 5 is an isometric view of the drill head from FIG. 4 from a second perspective.

Referring now to FIGS. 4 and 5 which illustrate the drill head 4 having the cutter bar 12 positioned in front of the annular shell 11 which an annular body 25 located to the rear of the annular shell 11. The annular body 25 illustrated includes three casings 26 with covers 27 (see FIG. 1) removed to expose internal features of the drill head 4. It can be appreciated from FIG. 5 that the proximal end of the annular body 25 includes a pair of elongate pins 27 with a nut 28 positioned to the rear thereof which are adapted to interact with the apertures 17 and catch mechanism 18 described with reference to the string segments 9 illustrated in FIG. 3. Further, FIG. 5 illustrates an input shaft 29 that is adapted to interact with the drive shaft 15 as illustrated in FIG. 3. Still further, the proximal end of the annular body 25 illustrated also includes an air cavity 30 and an exhaust cavity 31 each having a respective third seal 32 and fourth seal 33 so as to connect with the first conduit 20 and second conduit 21 when the drill head 4 is attached to an adjacent string segment 9. The air cavity 30 can include a pressure sensor therein for comparison with atmospheric pressure so as to detect air flow blockages. FIG. 5 also illustrates a slot 34 adjacent the air cavity 30 which can accommodate the cables (not shown) providing them with access to the internal features of the drill head 4.

Figure 6:
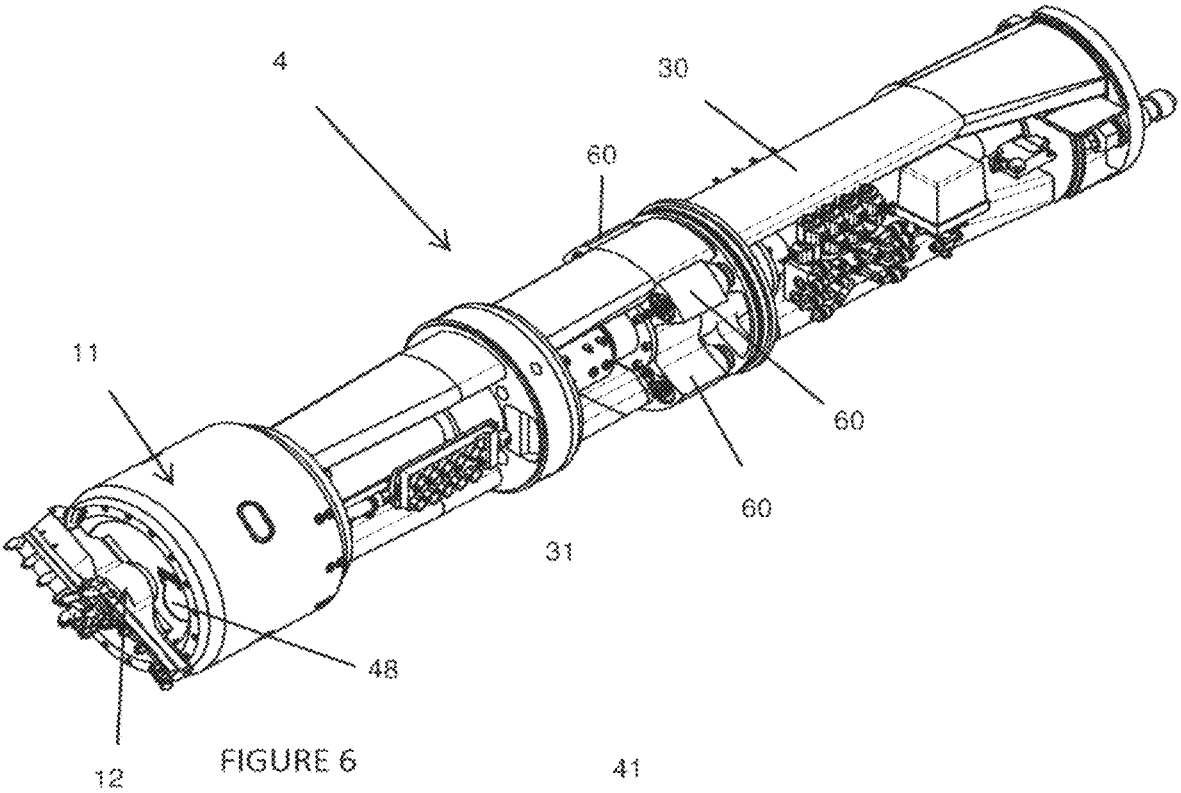
FIG. 6 is an isometric view of the drill head from FIG. 4 with the casing of the annular body removed to illustrate the air cavity and the exhaust cavity.
Figure 13:
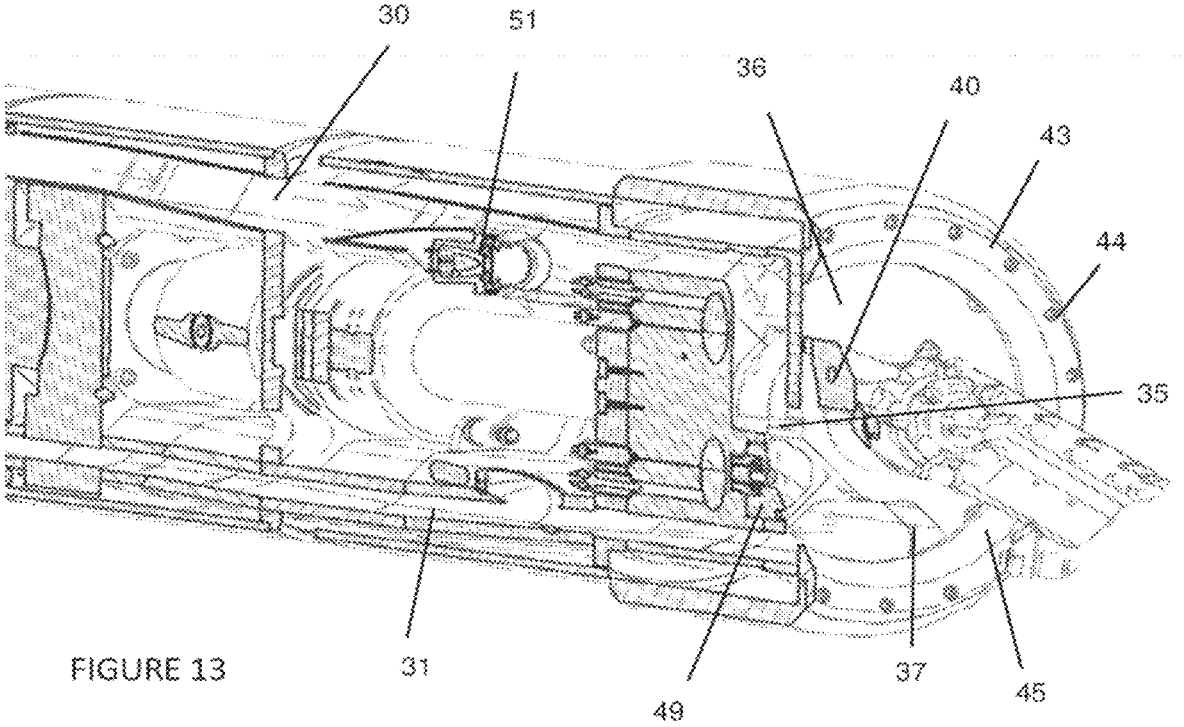
FIG. 13 is a sectional view of the drill head showing the air flow path.

Referring now to FIG. 6 which illustrates the drill head 4 with the casings 26 removed to reveal the air cavity 30 and the exhaust cavity 31 each extending longitudinally of the housing. Referring briefly to FIG. 13 it can be appreciated that the air cavity 30 provides an air flow path along the annular body 25, through the annular shell 11 and out through an air aperture 35 formed in a radial plate member 36. The radial plate 36 also includes an exhaust aperture 37 through which air and swarf can be extracted along the exhaust cavity 31 and back to the drive apparatus 2 (see FIG. 1).

Figure 7:
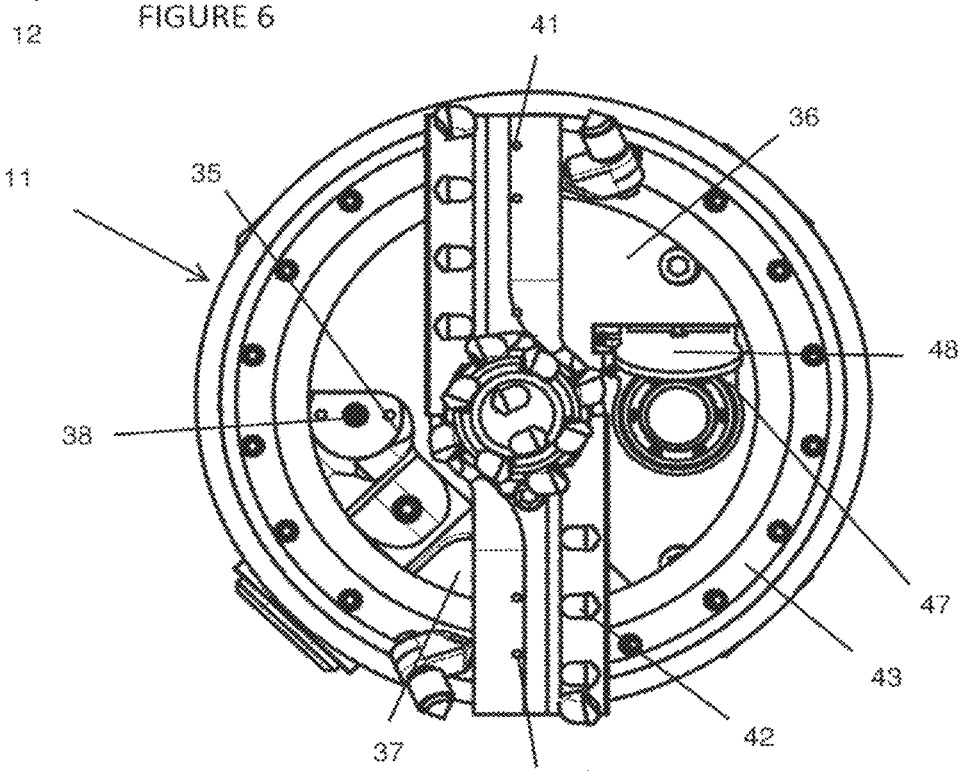
FIG. 7 is a front elevation view of the distal end of the drill head.
Figure 11:
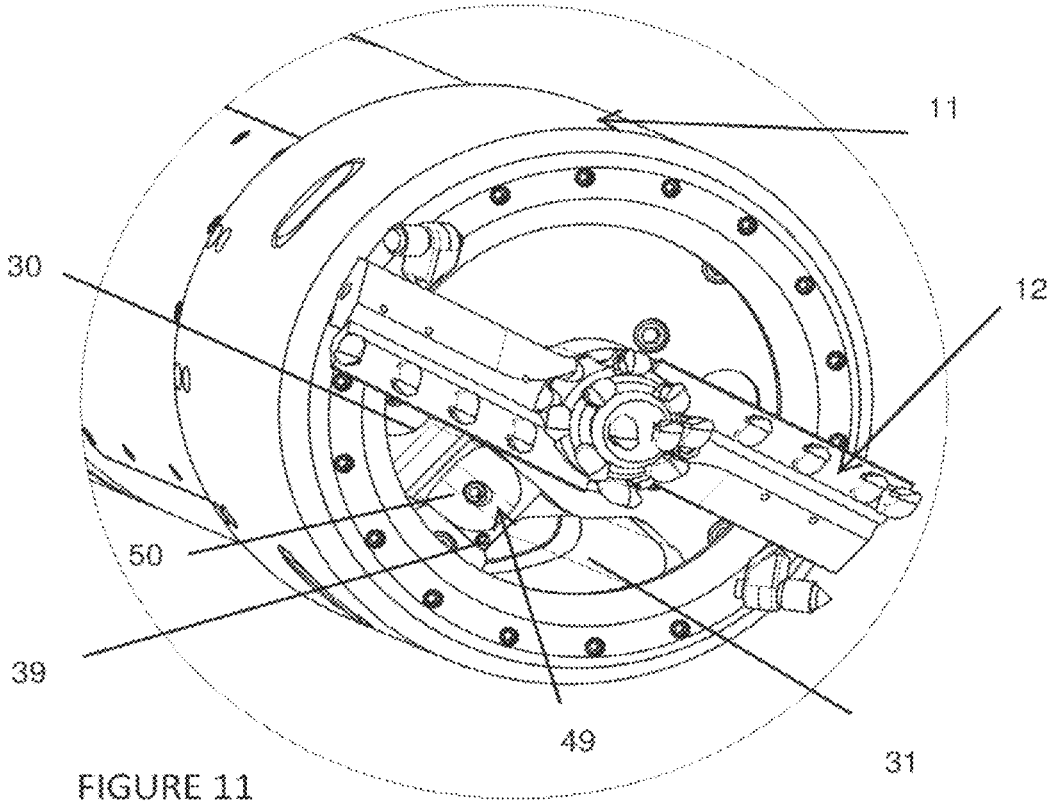
FIG. 11 is an isometric view of the distal end of the drill head with a throat member in an extended position.

FIG. 7 illustrates a spray outlet, hereinafter referred to as an exhaust spray 38, through which cleaning fluid can be sprayed from within the annular shell 11 towards the exhaust aperture 37 in order to facilitate extraction of swarf from the working zone 13. FIG. 11 illustrates a spray outlet, hereinafter referred to as a housing spray 39 which is adapted to spray cleaning fluid towards the cutter bar 12. Whilst the cutter bar 12 is formed with a hollow 40 (see FIG. 13) which extends longitudinally thereof terminating in a number of spray outlets, hereinafter referred to as bar sprays 41 that are adapted to project towards the working face 10 (see FIG. 7) and back towards the radial plate 36 which are on the rear side of the cutter bar 12 an obscured in the illustrations provided. The sprays 38, 39 and 41 may be operated purely for cleaning (cleaning mode) or operated in conjunction with the cutter car 12 (extraction mode) as can be determined by the operator.

Figure 8:
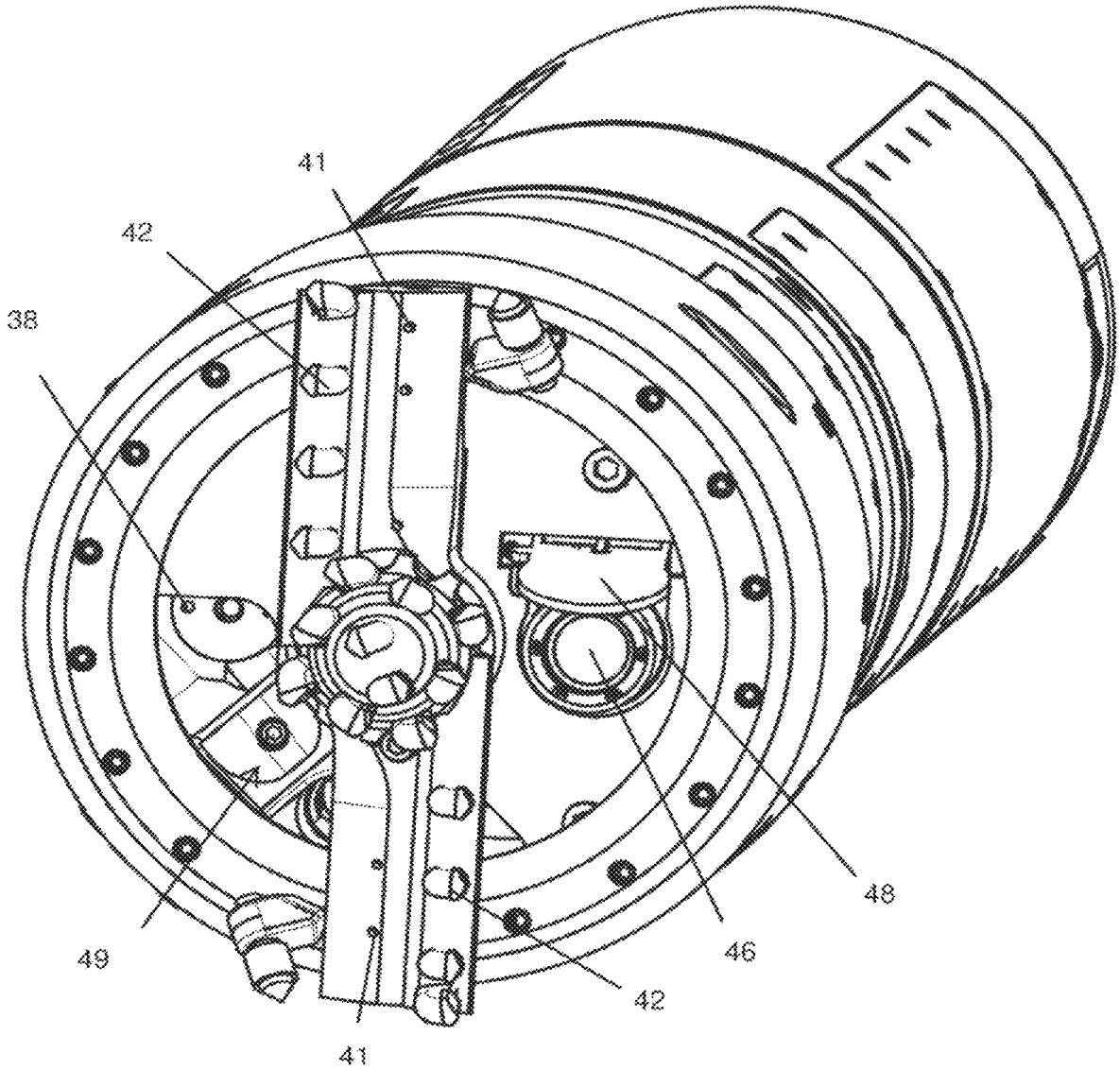
FIG. 8 is an isometric view of the distal end of the drill head from FIG. 7.
Figure 9:
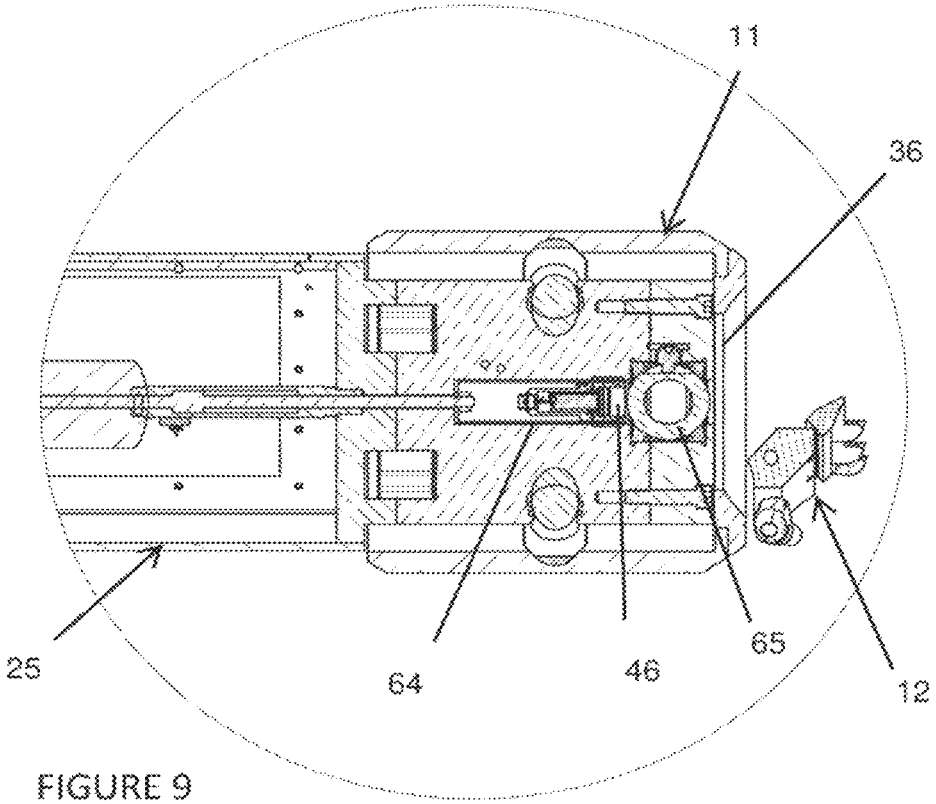
FIG. 9 is a sectional view of the distal end of the drill head with a movable imaging device in a retracted position.
Figure 10:
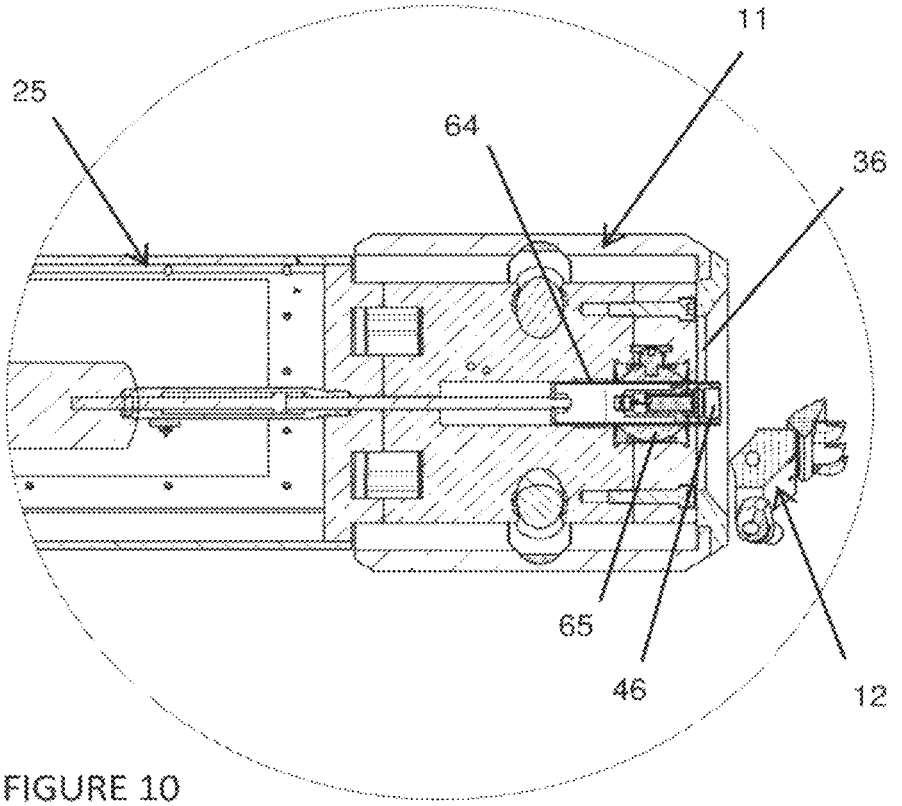
FIG. 10 is a sectional view of the distal end of the drill head from FIG. 9 with the movable imaging device in an extended position.

The cutter bar illustrated in FIG. 7 is formed with a plurality of cutting elements 42 positioned there along, the number and location of which may vary from that as illustrated. FIG. 7 also illustrates an annular ring 43 attached to the annular shell 11 by way of a plurality of bolts 44. It can be appreciated from FIG. 13 that the annular ring 43 includes a frustoconical surface 45. It is intended that the annular ring 43 be interchangeable so as to select a ring having a frustoconical surface 45 with an angle and length to suit the ground conditions. FIG. 7 also illustrates a movable imaging device 46, which may take the form of a digital camera. It can be appreciated from FIG. 8 that the radial plate 36 has an imaging aperture 47 formed therein and a cover 48 (see also FIG. 6) which is movable between a closed position (FIG. 6), and an open position (FIG. 8). Referring briefly to FIGS. 9 and 10 which illustrate the movable imaging device 46 adjustable between a retracted position as shown in FIG. 9 to an extended position as shown in FIG. 10. The movable imaging device 46 is illustrated in FIG. 9 at the end of a tube 64 with a ball type valve 65 also in a closed position providing further protection to the movable imaging device 46. When the tube 64 is moved, as illustrated in FIG. 10, the ball type valve is pivoted to an open position. In this way the movable imaging device 46 can capture images in the working zone 13, and in particular forward of the radial plate 36, when the cutter bar 12 is stopped, and is protected from the working zone 13 when the cutter bar 12 is rotating.

Figure 12:
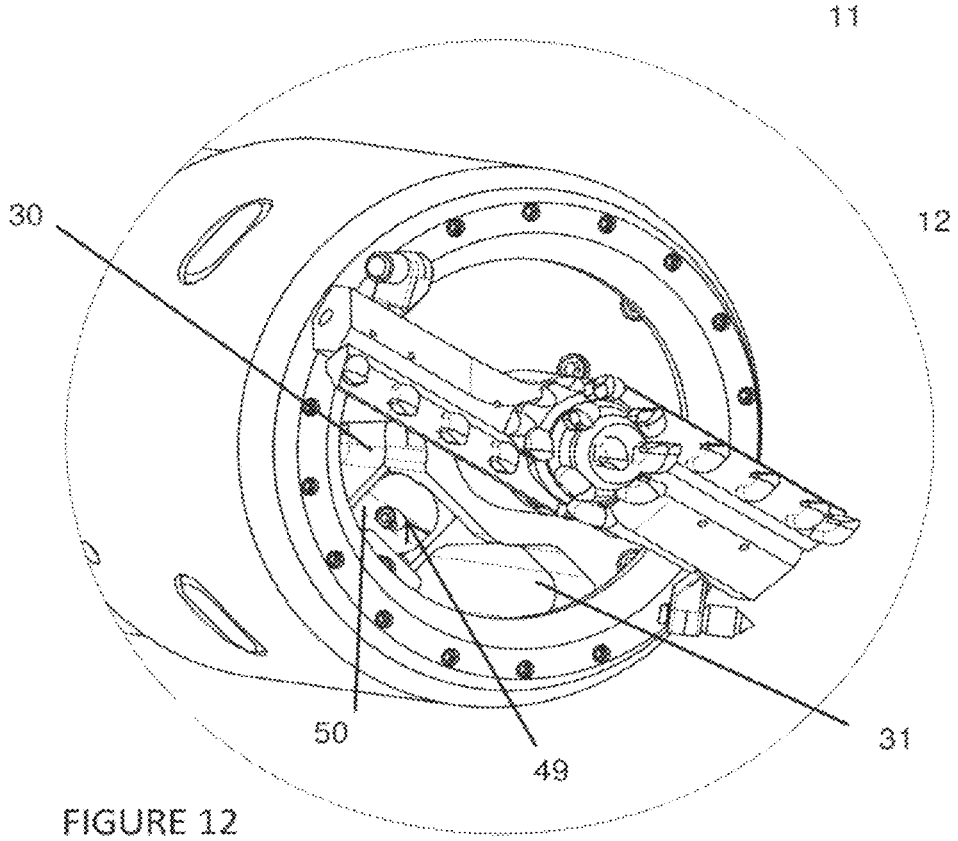
FIG. 12 is an isometric view of the distal end of the drill head from FIG. 11 with the throat member in a retracted position.

The drill head according to one aspect of this invention includes a pressure adjustment mechanism at the distal end of annular shell 11 for adjusting air pressure in the working zone 13. It has been previously explained with reference to FIG. 13 that an air flow pathway is established between the air cavity 30 and the exhaust cavity 31, whereby it enters and exits the working zone 13 through the air aperture 35 and exhaust aperture 37 in the radial plate 36 respectively. A throat member 49 is positioned approximate the air aperture 35 and exhaust aperture 37 and provides a curved surface 50 over which the air flows between the air aperture 35 and the exhaust aperture 37. The position of the throat member 49 is adjustable by an operator remoter form the working zone between an extended position as illustrated in FIG. 11, and a retracted position as illustrated in FIG. 12 so as to adjust the characteristics of the air flow path between the air apertures 35 and the exhaust aperture 37 moving through the working zone 13. The inventor has appreciated that when the throat member 49 is an extended position it produces a maximum negative pressure in the working zone, whilst when the throat member 49 is in the retracted position it produces a minimum negative pressure in the working zone 13. In this way swarf is more aggressively extracted from the working zone through the exhaust aperture 37 when the throat member 49 is in the extended position, and less aggressively extracted from the working zone 13 when the throat member 49 is in the retracted position. This allows the cutter bar 12 to appropriately process the swarf across the entire working face 10 of the bore 8, rather than swarf being extracted from a lower portion of the working face 10 by an overly aggressive negative pressure. The cabling in the channel 22 allows for the operator to communicate with and control functions of the drill head 4 in a location remote from the working zone, such as in the pit 7, including to adjust the position of the throat member 49.

Figure 17:
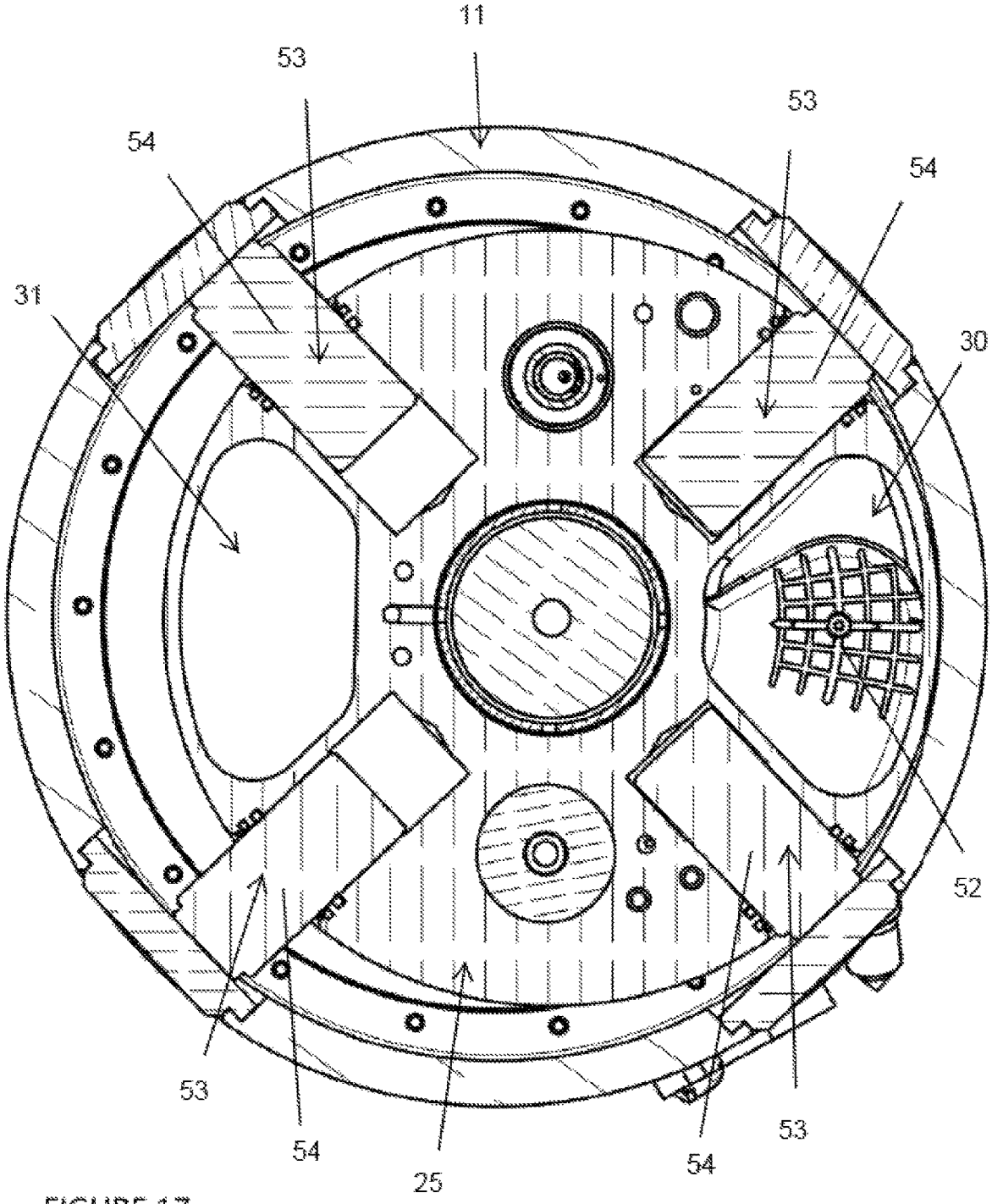
FIG. 17 is a sectional view through the annular shell also illustrating the rear surface of the radial member.

FIG. 13 also illustrates a fixed imaging device 51 positioned in the air cavity 30 which is adapted to project images captured from a rear surface of the radial plate 36. FIG. 17 illustrates the radial plate 36 being formed with a target 52 whereby in use a laser beam (not shown) can be projected along the first conduit 20 and air cavity 30 towards the target 52 with the fixed imaging device 51 providing images to the operator to enable them to determine whether the drill head is moving in a straight path. Where the operator has appreciated that the drill head 4 is deviating from the straight path, the position of the annular shell 11 can be adjusted relative to the annular body 25 through the operation of any one or more of radially mounted rams, hereinafter referred to as shell rams 53. Each shell ram 53 includes a shell piston adapted to engage an inner surface of the annular shell 11 so that adjustment of the position of each of the shell pistons 54 causes adjustment of the position of the annular shell 11 relative to the annular body 25.

Figure 14:
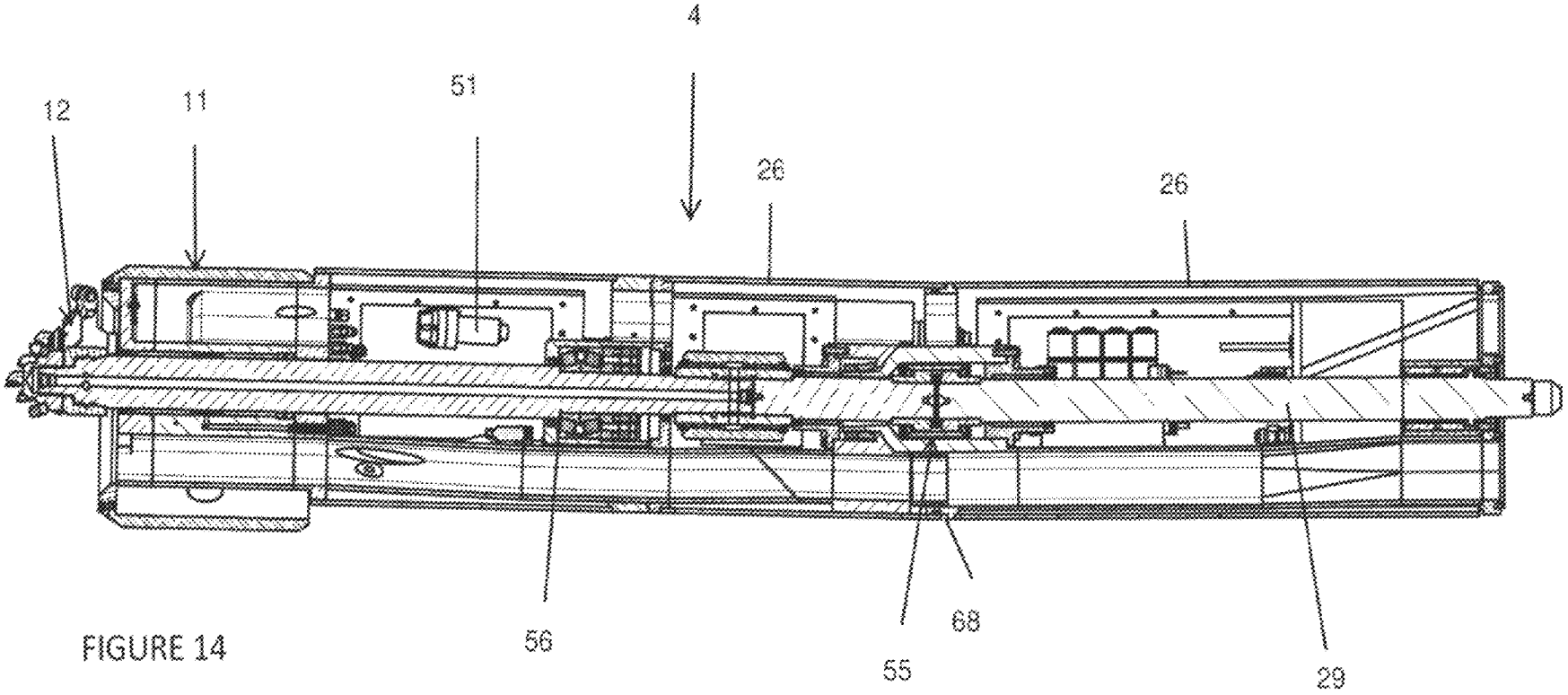
FIG. 14 is a sectional view of the drill head showing the articulation in the annular body.

The inventor has appreciated that whilst adjusting the position of the annular shell 11 relative to the annular body 25 does provide some degree of steering, providing the annular body 25 with some degree of articulation enhances the steering capability. FIG. 14 illustrates a preferred embodiment of an articulated joint 55 according to another aspect of this invention. The preferred degree of articulation is up to three degrees from the axis of the input shaft 29, however this degree of articulation may vary. FIG. 14 illustrates an input shaft 29 and an output shaft 56 positioned on either side of the articulated joint 55. The output shaft 56 extends directly, or indirectly to the cutter bar 12 so that rotation of the input shaft 29 results in rotation of the output shaft 56 and rotation of the cutter bar 12.

Figure 15:
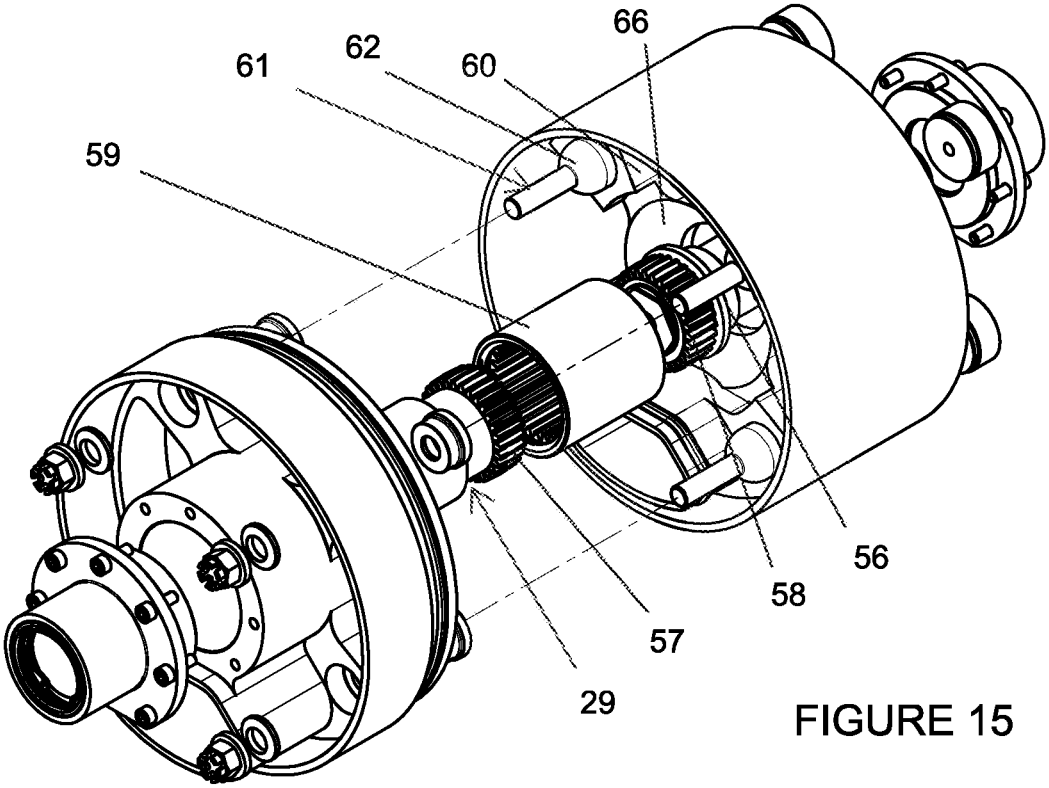
FIG. 15 is an isometric view of a preferred embodiment of the articulated joint from a first perspective.
Figure 16:
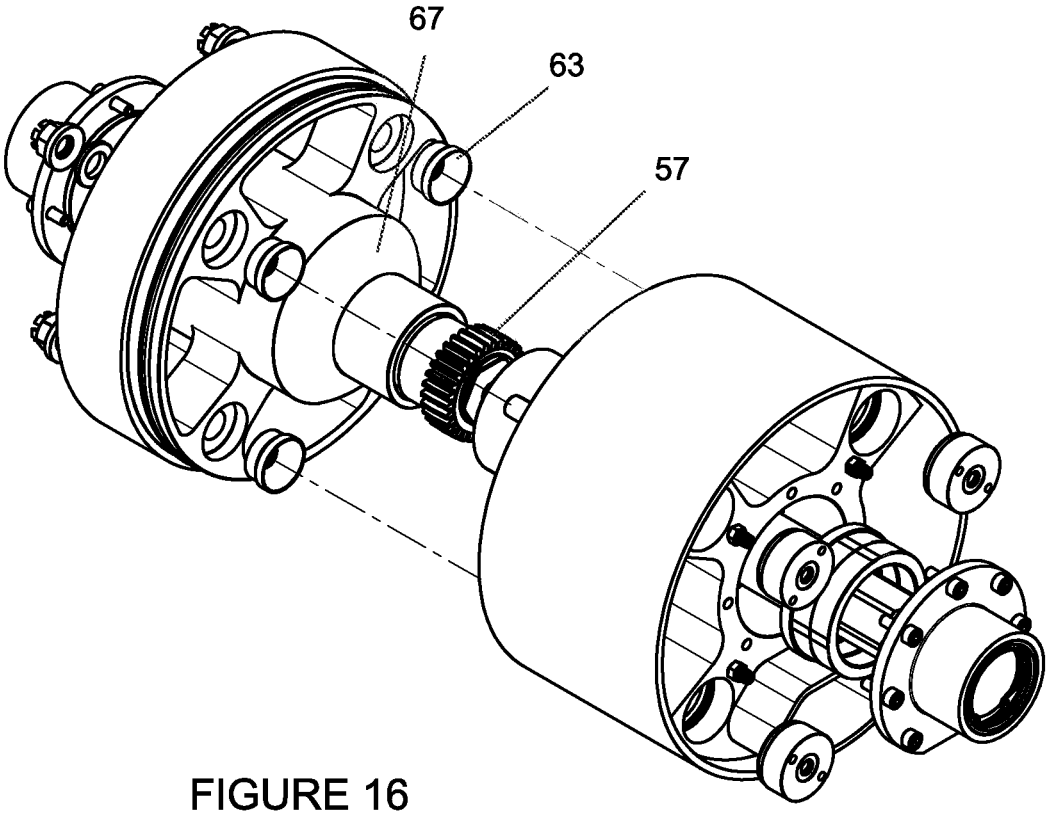
FIG. 16 is an isometric view of the articulated joint from FIG. 15 from a second perspective.

A preferred embodiment of the articulated joint 55 is illustrated in FIGS. 15 and 16 showing the input shaft 29 formed with a drive gear 57, the output shaft 56 is formed with a driven gear 58 and a gear sleeve 59 connects the drive gear 57 with the driven gear 58. Each of the teeth on the drive gear 57 and driven gear 58 are preferably crescent shaped so as to permit the angle of articulation required through the gear sleeve 59.

FIG. 15 illustrates the articulated joint 55 including four hydraulic rams, hereinafter referred to as articulation rams 60 each having an articulation piston 61. Each articulated piston 61 is provided with a part spherical surface 62 that is adapted to seat in a socket 63 on opposed sides of the articulated joint 55 so that axial movement of each articulation piston 61 will still allow for angular adjustment through the articulated joint 55. Further a concave surface 66 (see FIG. 15) on one side of the articulated joint bears on a convex surface 67 (see FIG. 16) on an opposed side of the articulated joint 55 so as to permit thrust to be transferred thought the articulated joint 55. It is also preferred to include a seal 68 (see FIG. 14) between adjacent casings 26. The use of the articulation rams 60 in this way, and their location to the rear of the annular shell 11 within the annular body 25, provides the operator with a further degree of steering capability in addition to the steering capability achieved by the shell rams 53.

Various alterations and/or additions may be introduced into the reamer assembly as hereinbefore described without departing from the spirit or ambit of the invention.

What is claimed is:

1. A drill head for use with a microtunneling apparatus to produce a bore including a housing having an annular shell and a radial member adjacent a distal end of the housing, a cutter bar having at least one cutting element positioned for front cutting, the cutter bar is rotatable across the radial member within a working zone of the bore to produce swarf, an air cavity extending longitudinally of the housing leading to an air aperture in the radial member for supplying air to the working zone, the radial member having at an exhaust aperture leading to an exhaust cavity extending longitudinally of the housing for extracting swarf from the working zone, the air cavity, the working zone and the exhaust cavity defining an air flow path, a pressure adjustment mechanism operable at the distal end of the housing for adjusting air pressure in the working zone so as to adjust the extraction of swarf from the working zone.

2. The drill head according to claim 1 wherein the pressure adjustment mechanism includes a throat member that is positioned between the air aperture and the extraction aperture to create a venturi flow therebetween, the throat member is adjustable to control venturi flow of air in the working zone.

3. The drill head according to claim 2 wherein the throat member includes a curved surface which is positioned in the air flow path.

4. The drill head according to claim 3 wherein the throat member is movable between an extended position and a retracted position relative to the radial member.

5. The drill head according to claim 4 wherein the throat member is adapted such that when in the extended position a maximum negative pressure is developed in the working zone and when in the retracted position a minimum negative pressure is developed in the working zone.

6. The drill head according to claim 1 wherein the cutter bar has at least one spray outlet (hereafter bar spray) adapted for spraying fluid towards the radial member.

7. The drill head according to claim 1 wherein the housing has at least one spray outlet (hereafter exhaust spray) adapted for spraying fluid towards the exhaust aperture.

8. The drill head according to claim 7 wherein the housing has at least one spray outlet (hereafter housing spray) adapted for spraying fluid towards the cutter bar.

9. The drill head according to claim 1 including an annular body to a rear of the annular shell, an input shaft at a proximal end of the annular body that is rotatable about a drive axis, an output shaft extending towards the distal end of the annular shell associated with the cutter bar so that the cutter bar rotates about an output axis, an articulated coupling within the housing between the input shaft and the output shaft that is adjustable so as to adjust an angle of articulation between the input shaft and the output shaft.

10. The drill head according to claim 9 wherein the articulated coupling includes a drive gear associated with the input shaft, a driven gear associated with the output shaft and geared sleeve which are adapted to allow for adjustment of the articulated coupling.

11. The drill head according to claim 10 including a plurality of radially mounted actuators positioned about the articulated joint for adjusting the angle of articulation wherein the actuators are hydraulic rams (hereafter articulation rams) each including a piston (hereafter articulation piston) which is arranged to move in a longitudinally of the housing, each articulation piston having a part spherical surface adapted to interact with a socket so as to allow the articulation piston to move axially while permitting angular adjustment of the articulated coupling.

12. The drill head according to claim 11 wherein the annular shell is adapted to move radially relative to the annular body for adjustment of the direction the annular shell within the bore when in use.

13. The drill head according to claim 12 including a plurality of radially mounted hydraulic rams (hereafter shell rams) each including a piston (hereafter shell piston) which is arranged to engage an inner surface of the annular shell and adapted to move in a radial direction so as to adjust the position of the annular shell relative to the annular body.

14. A microtunneling apparatus for producing a bore including a drive apparatus for location in a pit, a drill string for connection to the drive apparatus, the drill string having a drive shaft that is rotatable on operation of the drive apparatus, the drill head according to claim 1 for connection to the drill string such that rotation of the drive shaft results in rotation of the cutter bar.

15. The microtunneling apparatus according to claim 14 including a pair of elongate members located at proximal end of the housing for interacting with a latch connection at a distal end the drill string each elongate member is adapted to be adjustable so as to vary the tolerance between proximal end of the housing and the distal end of the drill string.

16. The microtunneling apparatus according to claim 15 wherein the drill string being formed by a plurality of connected string segments each string segment including a latch connection for manually connecting adjacent string segments.

17. The microtunneling apparatus according to claim 16 wherein the drill string includes a first cavity adapted for supplying air from the drive apparatus to the working zone and a second cavity for extracting swarf from the working zone to the drive apparatus.

18. The microtunneling apparatus according to claim 17 wherein the first cavity is also adapted for sighting a laser there along to a rear surface of the radial member.

19. The microtunneling apparatus according to claim 18 wherein the drill string includes a channel extending longitudinally thereof to accommodate cabling extending between the drive apparatus and the drill head so as to allow for operation of the drill head by an operator remote from the working zone, including at least adjustment of the pressure adjustment mechanism remote from the working zone.

* * * * *